United States Patent [19]

Jacobsson

[11] Patent Number: 4,835,988

[45] Date of Patent: Jun. 6, 1989

[54] TWO WHEEL DEVICE FOR POSITVE FEEDING OF YARN TO KNITTING MACHINE

[75] Inventor: Kurt A. G. Jacobsson, Ulricehamn, Sweden

[73] Assignee: Aktiebolaget IRO, Ulricehamn, Sweden

[21] Appl. No.: 74,457

[22] PCT Filed: Oct. 14, 1986

[86] PCT No.: PCT/EP86/00587

§ 371 Date: Jun. 12, 1987

§ 102(e) Date: Jun. 12, 1987

[87] PCT Pub. No.: WO87/02395

PCT Pub. Date: Apr. 23, 1987

[30] Foreign Application Priority Data

Oct. 14, 1985 [SE] Sweden ..... 8504766

[51] Int. Cl.[4] ..... D04B 15/48

[52] U.S. Cl. ..... 66/132 T; 242/47.01

[58] Field of Search ..... 66/132 R, 132 T; 242/47.01

[56] References Cited

U.S. PATENT DOCUMENTS

| | | | |
|---|---|---|---|
| 3,324,685 | 6/1967 | Schmidt et al. | 66/132 R |
| 3,651,668 | 3/1972 | Pernick | 66/132 T |
| 3,672,590 | 6/1972 | Rosen | 66/132 R X |
| 4,136,837 | 1/1979 | Fecker et al. | 242/47.01 |
| 4,165,048 | 8/1979 | Paepke | 242/47.01 |

FOREIGN PATENT DOCUMENTS

| | | | |
|---|---|---|---|
| 2408674 | 6/1979 | France . | |
| 2109825 | 6/1983 | United Kingdom | 66/132 T |

*Primary Examiner*—Wm. Carter Reynolds

*Attorney, Agent, or Firm*—Flynn, Thiel, Boutell & Tanis

[57] ABSTRACT

A device for positive feeding of yarn to a knitting machine, which device has independently rotatable first and second wheels disposed axially closely adjacent and individually supported for rotation about first and second axes which extend in the same general direction but are slightly inclined relative to one another. First and second feeding tapes are drivingly engaged with the first and second wheels respectively. A shiftable yarn guiding element feeds a yarn therethrough to a selected one of the wheels, with the guiding element being shiftable between first and second positions to enable the yarn to be positively fed by the first and second wheels respectively.

14 Claims, 4 Drawing Sheets

TWO WHEEL DEVICE FOR POSITVE FEEDING OF YARN TO KNITTING MACHINE

FIELD OF THE INVENTION

The present invention relates to a device for the positive feeding of yarn to a knitting machine, preferably a circular knitting machine, for knitting pieces of goods with a ready-made-up length, in which every knitted piece has portions with a different stitch length or knitting structure.

BACKGROUND OF THE INVENTION

The invention is based on a device which has a yarn feeding wheel which is freely journalled on a fixed shaft in the device, and a feeding tape synchronously driven by the knitting machine, which tape is adapted to run over a part of the periphery of said yarn feeding wheel with a desired speed. A yarn control element associated with the yarn feeding wheel is also arranged to bring the yarn into engagement with the yarn feeding wheel and the yarn feeding tape, co-acting therewith for the positive feeding of the yarn to the knitting place with said desired speed and also to guide the yarn out of this engagement into a position outside the feeding tape on the yarn feeding wheel to interrupt the positive feeding thereof.

In the case of knitting pieces of goods with ready-made-up lengths, and also in other connections, there is a requirement for being able to positively feed a yarn in one and the same knitting system with at least two different speeds during the various parts of the knitting cycle for such goods. For example, an instance can be mentioned where one knits a "pullover", where the short, lower-most section in the form of a "waist rib" should be knitted with a first positive yarn speed for generating a first portion in the goods with a first stitch size and character. Immediately thereafter, the long breast and belly section ("body section") is to be knitted with a second, positive yarn speed for generating a second portion in the goods with a second stitch size and character. This case is described in detail in the British Patent Specification No. 1.246.625 (Hosiery and Allied Trade Research Association, Nottingham), which also shows a yarn feeding device consisting of so-called "nip rollers" which enables the desired positive feeding of a yarn with two different speeds in one and the same knitting system during various parts of the knitting cycle.

GB-A-2 109 825 already discloses a device for the positive feeding of yarn to a knitting machine. The prior art device comprises two feeding wheels of different diameter which are caused to rotate at different rotational speeds. A number of turns of the yarn to be fed to the knitting machine are wound around the second wheel and a cone and further around the first wheel where the yarn is engaged by the feeding tape. Depending on the yarn tension, the yarn comes into and out of engagement with the feeding tape. Hence, the tension of the yarn can be controlled as desired. However, this prior art apparatus is not adapted for carrying out a positive feeding of the yarn at two different, clearly defined, speeds.

The object of the present invention is to accomplish a yarn feeding device adapted for a selective positive feeding of the yarn at different speeds having a less complicated structure than that of the prior art devices.

In accordance with the present invention, this object is achieved by a device.

A further object of the present invention is to ensure a permanently correct positioning of the feeding tapes on the two yarn feeding wheels, namely that the feeding tape on the respective yarn feeding wheel should always run over the wheel at its edge remote from the crossing between the two wheels. According to one embodiment of the invention, this object is accomplished by the rotation axes of the two yarn feeding wheels forming a small, acute angle, with each axis being inclined at a smaller angle from a line perpendicular, to the normal planes of movement for the two feeding tapes. This geometrical relationship is preferably accomplished by the journalling position for the further yarn feeding wheel on the fixed shaft consisting of a hub portion, the centre axis of which forms a small acute, "positive" angle to the centre line of the fixed shaft. The first yarn feeding wheel is journalled on a hub portion concentrically arranged with the centre line of the fixed shaft. Moreover, the whole yarn feeding device is arranged to be mounted on a support ring extending horizontally above the knitting machine and parallel to the feeding tapes in a conventional manner such that the centre line of the fixed shaft on which the two yarn feeding wheels are journalled, forms a small, acute, "negative" angle absolute relative to a line perpendicular to the normal planes of movement for the two feeding tapes. The "negative" angle has a smaller absolute valve than said "positive" angle.

Another object of the present invention is to facilitate the alteration of the speed of the yarn. Therefore, according to the invention, the device has, in one embodiment, an annular guiding flange fixed to the rim of the first yarn feeding wheel facing the further yarn feeding wheel and extending axially out over a small piece of the further yarn feeding wheel, which flange is adapted to enable the smooth sliding of the yarn over it from its position on the first yarn feeding wheel into a position on the further yarn feeding wheel, and vice versa.

BRIEF DESCRIPTION OF THE DRAWINGS

A preferred embodiment of the device according to the invention is described below with reference to the drawings, wherein.

DETAILED DESCRIPTION

Figure 1:
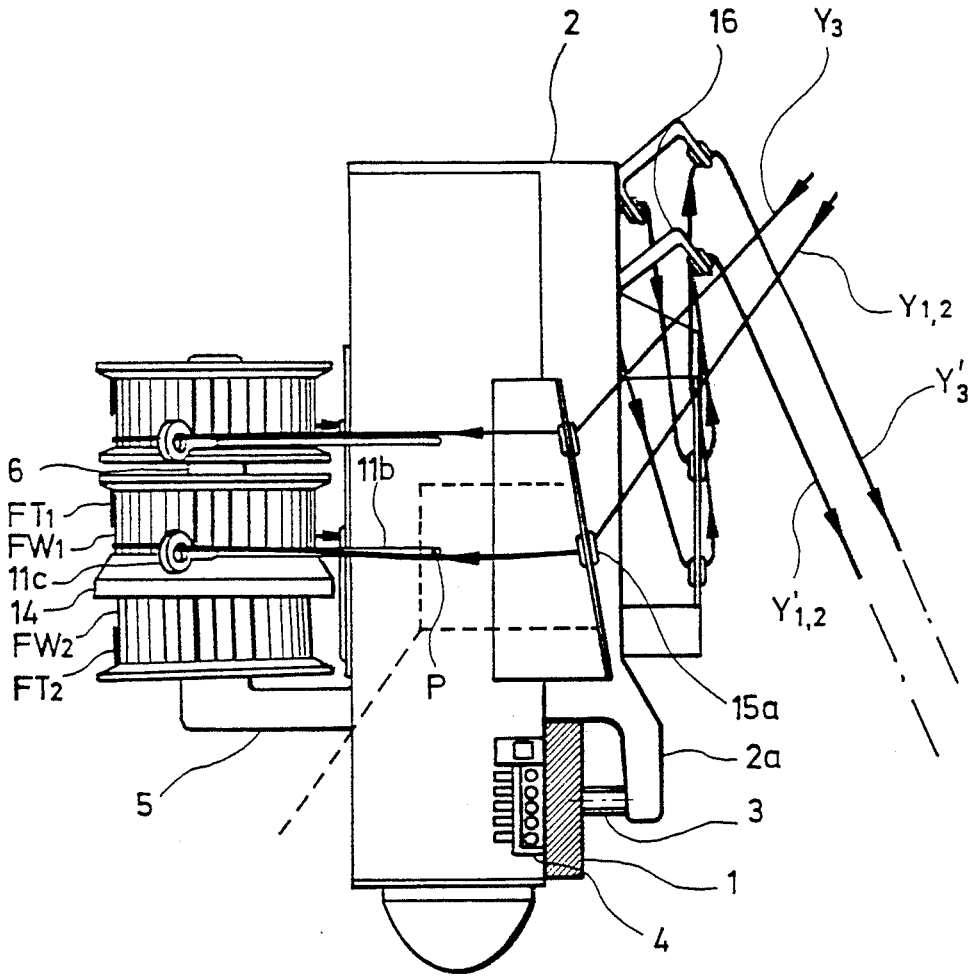
FIGS. 1 and 2 show two different views of this embodiment.
Figure 2:
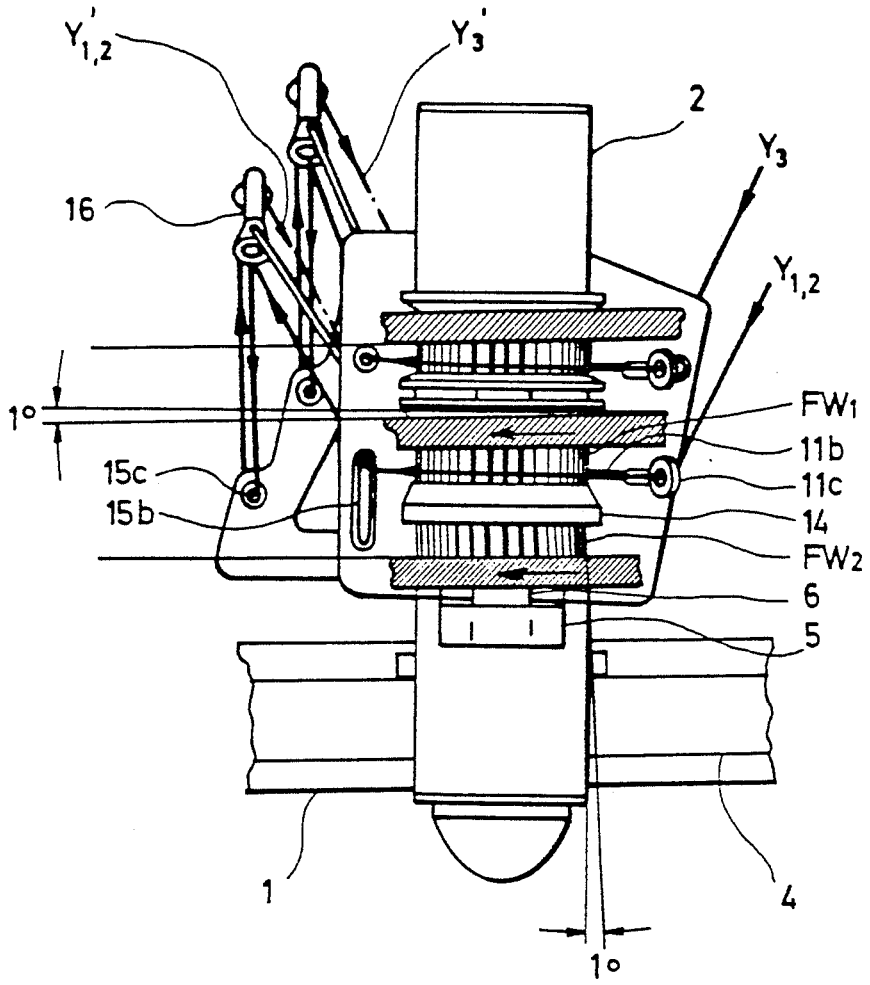

As shown at FIGS. 1 and 2, a knitting machine has a support ring 1 known per se, which is arranged to carry a number of identical yarn feeding devices. The respective feeding devices are located above the respective knitting places or yarn intakes of the circular knitting machine (not shown here), whereby said number corresponds to the number of knitting systems in the machine. Every yarn feeding device has a hook-formed attachment part 2*a* on the housing 2 which is intended for fitting the device to the support ring 1 in which a lock screw 3 is arranged for fixing the yarn feeding device on the support ring 1. On said support ring 1 a flat, electrical cable 4 comprising five electrical conductors which are principally the same as is shown in the Applicant's own European Patent Application No.

821101173.0 (publication No. 78 550) are connected to an electrical, preferably micro-processor-based control unit centrally arranged in the knitting machine. Two of the said conductors (not shown here) are connections connected to respective one of two electro-magnets $EM_1$ and $EM_2$ fixed in the housing 2 of the yarn feeding device, which electro-magnets are more closely shown in FIG. 4.

Figure 3:
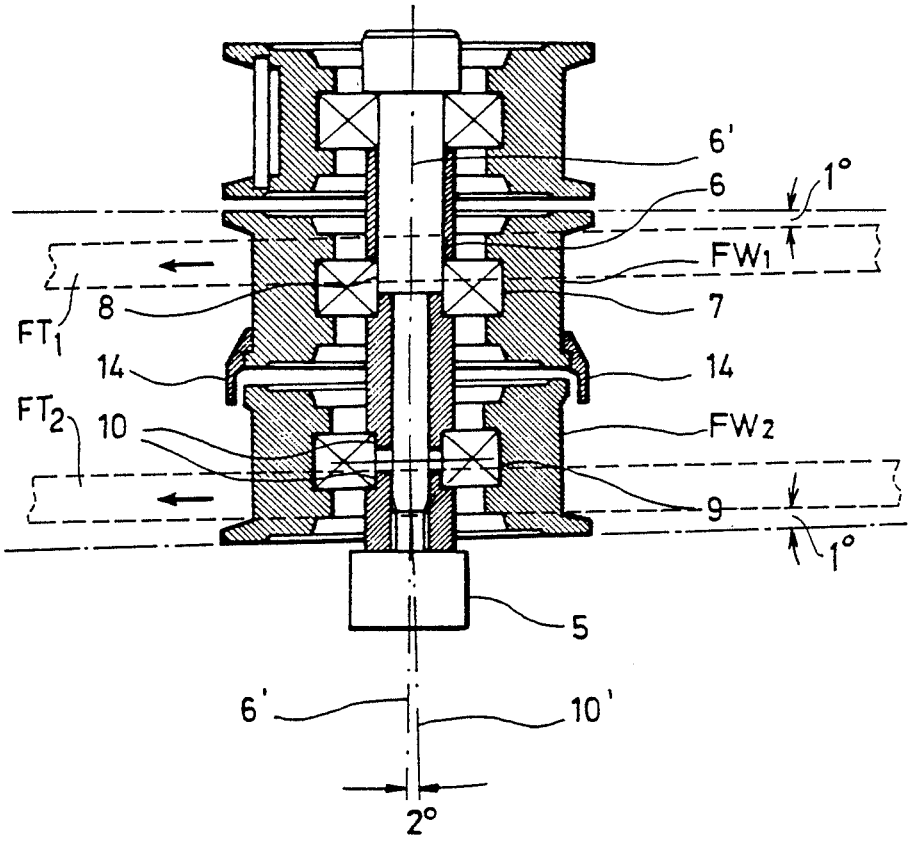
FIG. 3 shows the same embodiment where vital parts in the device are shown in longitudinal sections.

In supporting plate 5 projecting from the housing 2 a vertical, fixed (unrotatable) shaft 6 is attached. A first yarn feeding wheel $FW_1$ is by means of a ball bearing 7 (see FIG. 3) pivotably journalled on a hub portion 8 on the shaft 6 concentrically arranged with the centre line 6' of the shaft 6. A further yarn feeding wheel $FW_2$ via a further ball-bearing 9 is rotatably journalled on a second hub portion 10 on the shaft 6, whereby the centre line 10' of said second hub portion 10 forms a 2° angle to the centre line 6' of the shaft 6.

First and second feeding tapes $FT_1$, $FT_2$ are arranged to run over a part of the periphery of the respective yarn feeding wheels with first and second different linear speed $v_1$, $v_2$, synchronous with the drive of the knitting machine. Said speeds correspond to the positive feed speeds with which a yarn $Y_{1,2}$ from a yarn supply spool is, according to the present invention, fed by means of the yarn feeding device down to the working needles in the knitting machine as mentioned above so as to knit the "waist rib portion" or the "belly and breast section" in the pullover. The feeding tapes $FT_1$ and $FT_2$ are driven from the drive system of the knitting machine via a respective so-called quality adjustment pulley with an adjustable drive diameter in order to achieve the desired speeds $v_1$, $v_2$ synchronous with the needle cylinder speed.

At point P in the housing 2 in the yarn feeding device, a yarn guiding arm 11 is pivotally journalled, which has a horizontal bearing part **11*a* and a guiding part 11*b* essentially perpendicular thereto which, at its free end, carries a yarn guiding eyelet 11*c*** for guiding the position of the in-coming yarn $Y_{1,2}$ in the yarn feeding device.

The yarn guiding arm 11 is an arrangement of two electro-magnets $EM_1$ and $EM_2$ and a common return spring RS adapted to be able to take one of three possible positions through a control command from the above-mentioned, preferably a micro-processor-based electronic control unit, centrally arranged in the knitting machine via two of the conductors in the flat cable 4.

Figure 4:
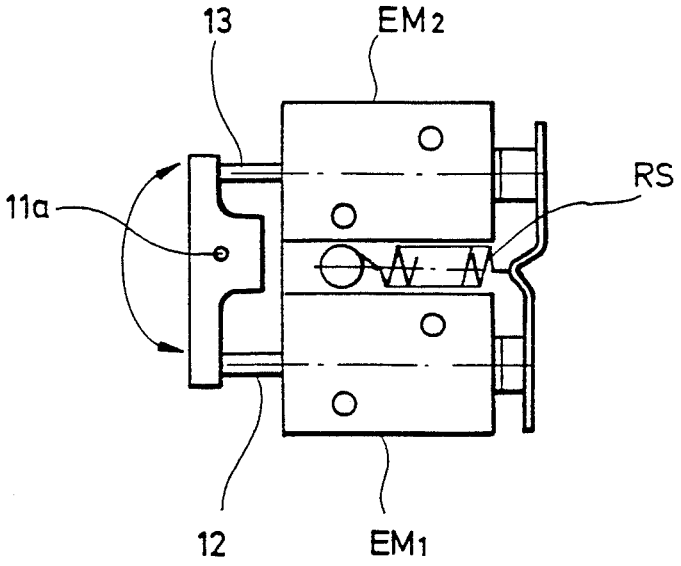
FIG. 4 shows the actuation means for the yarn control element in a more detailed form.

When none of the electro-magnets are actuated, the yarn guiding arm 11 will take the "neutral position" shown in FIGS. 1, 2 and 4 through the influence of the return spring RS. The yarn $Y_{1,2}$ running through the yarn guiding eyelet **11*c*** will be in a position outside the feeding tape $FT_1$ on the yarn feeding wheel $FW_1$ in which it will not be subject to any positive feed. The working needles in the machine will, themselves, pull the yarn $Y_{1,2}$ from the yarn supply spool via the wheel $FW_1$ rotating with the speed $v_1$.

During actuation of the lower electro-magnet $EM_1$, the yarn guiding arm 11 will pivot in a clockwise direction under the influence of the movement of the armature 12 so that the yarn $Y_{1,2}$ comes into engagement between the feeding tape $FT_1$ and the yarn feeding wheel $FW_1$, whereby the yarn $Y_{1,2}$ will be subjected to positive feeding with the speed $v_1$ of the feeding tape $FT_1$.

During de-actuation of the lower electro-magnet $EM_1$ and directly following actuation of the upper electro-magnet $EM_2$, the yarn guiding arm 11 swivels in an anti-clockwise direction, whereby the yarn $Y_{1,2}$ leaves its engagement between the feeding tape $FT_1$ and the wheel $FW_1$ via its "neutral position" shown in the Figures. This is utilized for making the first course of stitches in the goods to be knitted and, during adjustment and re-adjustment work in the machine, the yarn is moved over, under the influence of the movement of the armature 13 into an analogous engagement below the further feeding tape $FT_2$ so that, instead, the yarn $Y_{1,2}$ will be subjected to positive feeding with the speed $v_2$ of the feeding tape $FT_2$.

By means of an annular guiding flange 14 attached to the lower rim of the wheel $FW_1$ and preferably made of highly polished aluminium, which flange extends axially out over a small piece of the wheel $FW_2$, the wandering of the yarn $Y_{1,2}$ from the one yarn feeding wheel to the other, and vice versa, will be facilitated.

When the yarn is drivingly engaged between the tape $FT_1$ and the wheel $FW_1$, then the yarn guiding eyelet **11*c* will be in its uppermost position (that is, displaced upwardly from the neutral position shown in FIG. 2). However, when the yarn is to be fed by the other feeding wheel $FW_2$, then the arm 11 is pivotally swung downwardly so that the yarn guiding eyelet 11*c* is moved downwardly through the neutral position into a lowermost position wherein it is disposed adjacent but spaced radially outwardly from the wheel $FW_2$. During this downward movement of the eyelet 11*c* the yarn is moved downwardly out from beneath the tape $FT_1$ and is slidably moved downwardly across the guiding flange 14 into engagement with the lower feeding wheel $FW_2$, whereupon the yarn is engaged between the tape $FT_2$ and the wheel $FW_2$. This downward displacement of the yarn is facilitated by the beveled or chamfered surface provided adjacent the upper edge of the annular guiding flange 14**.

When the yarn is to be again moved upwardly for re-engagement with the top feed wheel $FW_1$, the eyelet **11*c* is shifted upwardly through the neutral position back into its uppermost position, and this results in a portion of yarn extending from the eyelet 11*c* downwardly in inclined relationship across the edge of the guiding flange 14 into engagement between the driving tape $FT_2$ and the wheel $FW_2$. Due to the fact that the eyelet 11*c* is spaced radially outwardly a substantial distance from both the wheels and the guiding flange 14, and is also displaced circumferentially from the point where the tapes engage the respective wheels, this hence enables the yarn portion which extends downstream from the eyelet 11*c* to readily pass upwardly over the flange 14 when the eyelet 11*c* is moved upwardly. These relationships, coupled with the movement of the tape $FT_2$ and the associated movement of the wheel $FW_2$ facilitate the upward movement of the yarn out of engagement with the tape $FT_2$ so that the yarn can again be displaced upwardly by the upward movement of the eyelet 11*c*** for engagement between the tape $FT_1$ and the wheel $FW_1$.

As is apparent from FIG. 2, the whole yarn feeding device is mounted such with its attachment portion **2*a* onto the support ring 1, with which the two feeding tapes $FT_1$ and $FT_2$ are adapted to run parallel by means of the previously mentioned quality wheels and guiding-rollers (not shown here). The centre line 6' of the fixed shaft 6 in the device forms a 1° "negative" angle to the normal of the planes of movement for the two feeding tapes. Due to this, it will be ensured that the feeding tape $FT_1$ always runs over the wheel $FW_1$ adjacent its upper rim. As a consequence of said "inclined" mounting of the yarn feeding device on the support ring 1 and the previously mentioned angle of 2° between the centre line 10' of the hub portion 10 on the wheel $FW_2$ and also to the centre line 6' of the fixed shaft 6, said centre line 10'** will form a 1° "positive" angle normal to the planes of movement for the two feeding tapes through which it is analogously ensured that the feeding tape $FT_2$ will always run over the wheel $FW_2$ adjacent its lower rim.

The yarn feeding device comprises fixed guiding eyelets 15*a*, 15*b* and 15*c* for the yarn and a pivotally journalled yarn tensioning arm 16 which is also used for sensing the position of the yarn and for detecting a yarn breakage condition. The pivotable yarn tensioning arm 16 is known per se in the art.

In the embodiment of the invention shown in the drawings, the yarn feeding device also comprises a third yarn feeding wheel $FW_3$ which, like the wheel $FW_1$, is concentrically journalled on the fixed shaft 6. The wheel $FW_3$, with respect to the present invention, is irrelevant and, therefore, not described in more detail, co-acts with a feeding tape $FT_3$ for the positive feeding of another yarn $Y_3$ which, during certain parts of the knitting cycle, is utilized as strengthening thread, as in the above-described case, during the initial phase of knitting the "waist-rib" in the goods.

I claim:

1. In a device for the positive feeding of yarn to a knitting machine, including:

a first freely rotatable yarn feeding wheel;

a first feeding tape arranged to run over a part of the periphery of said first yarn feeding wheel, which first feeding tape is driven at a first speed in synchronism with the operation of the knitting machine;

a yarn guiding element adapted for selectively bringing the yarn into engagement with said first yarn feeding wheel and said first feeding tape so as to positively feed the yarn at the speed of the first feeding tape or bringing the yarn out of engagement with said first yarn feeding wheel for terminating the positive feeding of the yarn; and a second yarn feeding wheel adapted to be rotated at a speed which is different from the speed of the first yarn feeding wheel, the improvement comprising:

said second yarn feeding wheel being adapted to be rotated independent from said first yarn feeding wheel, a second feeding tape arranged to run over a part of the periphery of said second yarn feeding wheel, which second feeding tape is driven at a second speed different from said first speed, said second speed being in synchronism with the operation of the knitting machine, said second yarn feeding wheel being arranged adjacent to said first yarn feeding wheel, the axes of said yarn feeding wheels extending in approximately the same direction, and said yarn guiding element being adapted for selectively bringing said yarn into engagement with said second yarn feeding wheel and said second feeding tape so as to positively feed the yarn at the speed of the second feeding tape or bringing the yarn out of engagement with said second feeding tape for terminating said positive feeding, and for moving the yarn from one yarn feeding wheel to the other yarn feeding wheel and vice versa.

2. Device as claimed in claim 1, wherein the rotational axes of said first and second yarn feeding wheels are inclined with respect to each other so that the axes together form a small acute angle, and the rotational axes of said first and second yarn feeding wheels are arranged such that the respective ends of said yarn feeding wheels remote from the respective other yarn feeding wheel are slightly inclined versus the normal plans of movement of said feeding tapes.

3. Device as claimed in claim 2, wherein said second yarn feeding wheel is journalled at a hub portion of a fixed shaft, the centre axis of said hub portion forming said small acute angle together with the centre line of the fixed shaft, said first yarn feeding wheel being journalled at a hub part concentrically arranged with said centre line of said fixed shaft, and said yarn feeding device is adapted to be mounted on a support ring extending horizontally above the knitting machine and in parallel to the feeding tapes such that the centre line of the fixed shaft and a direction perpendicular to the plane of movement of the feeding tapes form a small acute angle having a smaller absolute value than the small acute angle defined by the centre axis of the hub portion and the centre line of the fixed shaft.

4. Device as claimed in claim 1, including an annular guiding flange fixed to a rim of the first yarn feeding wheel facing said second yarn feeding wheel, which flange slightly extends axially over said second yarn feeding wheel, which flange enables a smooth sliding of the yarn from the first yarn feeding wheel to the second yarn feeding wheel and vice versa.

5. Device as claimed in claim 2, wherein: the rotational axis of said first yarn feeding wheel is inclined at an angle of about 1° relative to a perpendicular to the normal plane of movement of said first feeding tape, the rotational axis of said second yarn feeding wheel is inclined at an angle of about 1° relative to a perpendicular to the normal plane of movement of said second feeding tape, and the small acute angle as defined by the rotational axes of said first and second yarn feeding wheels is about 2°, whereby the respective feeding tape tends to drivingly engage the respective yarn feeding wheel adjacent the respective axial end thereof which is remote from the other yarn feeding wheel.

6. Decive as claimed in claim 5, wherein said yarn guiding element is supported for shifting movement between first and second positions for respectively bringing the yarn into engagement with the first and second yarn feeding wheels, and actuator means for selectively effecting shifting of said yarn guiding element between said first and second positions, said actuator means including first and second electromagnetic actuators for respectively shifting said yarn guiding element into said first and second positions.

7. Device as claimed in claim 1, wherein said yarn guiding element is supported for shifting movement between first and second positions for respectively bringing the yarn into engagement with the first and second yarn feeding wheels, and actuator means for selectively effecting shifting of said yarn guiding element between said first and second positions, said actuator means including first and second electromagnetic actuators for respectively shifting said yarn guiding element into said first and second positions.

8. A positive yarn feeding device adapted to be mounted on a supporting ring of a circular knitting machine, comprising:

a support housing having means for permitting attachment to the support ring;

upright shaft means stationarily mounted on said support housing;

a first yarn feeding wheel freely rotatably supported on said shaft means for rotation about a first axis which is generally upright, and a first feeding tape arranged to run over a part of the periphery of said first yarn feeding wheel for driving said first wheel at a first speed in synchronism with the operation of the knitting machine;

a second yarn feeding wheel freely rotatably supported on said shaft means for rotation about a second axis which is generally upright, and a second feeding tape arranged to run over a part of the periphery of said second yarn feeding wheel for driving said second wheel at a second speed which is different from said first but which is in synchronism with the operation of the knitting machine;

said second wheel being disposed generally directly below and approximately coaxially aligned with said first wheel; p1 a yarn guiding element for selectively guiding a yarn into engagement with said first wheel;

a yarn guiding element for selectively guiding a yarn into engagement with said first and second feeding wheels, said yarn guiding element being mounted on said support housing for shifting movement relative thereto between (1) a first position wherein it guides the yarn into engagement with the first yarn feeding wheel and said first feeding tape so as to positively feed the yarn at said first speed and (2) a second position wherein it guides the yarn into engagement with said second feeding wheel and said second feeding tape so as to positively feed the yarn at said second speed; and actuator means mounted on said support housing for selectively shifting said yarn guiding element between said first and second positions to effect transfer of the yarn between said first and second feeding wheels.

9. Device according to claim 8, wherein the first axis extends at a first very small acute angle relative to a line which is perpendicular to the plane of movement of the first feeding tape so that the first feeding tape tends to engage the first feeding wheel adjacent the upper axial end thereof, and wherein said second axis extends at a second very small acute angle relative to a line perpendicular to the plane of movement of said second feeding tape so that the second feeding tape tends to engage the second feeding wheel adjacent the lower axial end thereof.

10. Device according to claim 9, including an annular guide flange fixed to one of the adjacent axial ends of one feeding wheel and projecting axially in surrounding relationship to the other of said adjacent axial ends as defined on the other feeding wheel to permit the yarn to smoothly shift between said first and second feeding wheels in response to shifting of said guiding element between said first and second positions.

11. Device according to claim 10, wherein the first and second feeding tapes have generally parallel planes of movement, and said first and second axes extend on slightly inclined relationship to one another and define a third small acute angle therebetween which equals the sum of said first and second acute angles.

12. Device according to claim 11, wherein each of said first and second acute angles is about 1°.

13. Device according to claim 8, wherein said actuator means includes electromagnetic means.

14. Device according to claim 8, wherein said yarn guiding element is movable into a third position wherein the yarn is free of driving engagement with both of said first and second yarn driving wheels, said third position being located between said first and second positions.

* * * * *

UNITED STATES PATENT AND TRADEMARK OFFICE

CERTIFICATE OF CORRECTION

PATENT NO. : 4 835 988

DATED : June 6, 1989

INVENTOR(S) : Kurt A.G. JACOBSSON

It is certified that error appears in the above-identified patent and that said Letters Patent is hereby corrected as shown below:

Column 6, line 12; change "plans" to ---planes---.

Column 6, line 52; change "Decive" to ---Device---.

Column 7, line 5; change "supporting" to ---support---.

Column 7, line 24; after "first" insert ---speed---.

Column 7, line 28; delete "p1 a yarn guiding element for".

Column 7, lines 29-30; delete in their entirety.

Column 8, line 27; change "on" to ---in---.

Signed and Sealed this

Third Day of April, 1990

*Attest:*

HARRY F. MANBECK, JR.

*Attesting Officer*

*Commissioner of Patents and Trademarks*